US009401117B2

(12) United States Patent
Park

(10) Patent No.: US 9,401,117 B2
(45) Date of Patent: Jul. 26, 2016

(54) MOBILE TERMINAL AND RESOLUTION COMPATIBILITY METHOD THEREOF

(71) Applicant: LG ELECTRONICS INC., Seoul (KR)

(72) Inventor: Jiyong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 480 days.

(21) Appl. No.: 13/624,698

(22) Filed: Sep. 21, 2012

(65) Prior Publication Data

US 2013/0076750 A1 Mar. 28, 2013

(30) Foreign Application Priority Data

Sep. 23, 2011 (KR) ..... 10-2011-0096580
May 25, 2012 (KR) ..... 10-2012-0056271

(51) Int. Cl.
*G09G 3/36* (2006.01)

(52) U.S. Cl.
CPC ..... *G09G 3/36* (2013.01); *G09G 2340/0407* (2013.01); *G09G 2370/022* (2013.01)

(58) Field of Classification Search
CPC ..... G06F 3/0488; G06F 17/30905; G06F 3/0481; G06F 3/14; G06F 3/1446; G06F 11/3419; G06F 13/00; G06F 17/212; G06F 17/245; G06F 17/30058; G06F 17/30064; G06F 17/30846; G06F 17/30852; G06F 2201/815; G06F 2201/86; G06F 2203/04806; G06F 3/0412; G06F 3/0416; G06F 3/0484; G06F 3/04842; G06F 3/0485; G06F 3/1431; G06F 3/1438; G06F 9/4443; G06F 9/4445; G06F 9/44526; G09G 2340/0407; G09G 2320/0606; G09G 2340/0414; G09G 2340/0421; G09G 2340/045; G09G 2340/0457; G09G 2340/0492; G09G 2340/145; G09G 2370/027; G09G 3/2003; G09G 5/00; G09G 5/026; G09G 5/24; G09G 5/28; G09G 5/34; G09G 5/42; G09G 2300/026; G09G 2340/14; G09G 2354/00; G09G 3/2088; G09G 5/363; G09G 5/391
See application file for complete search history.

(56) References Cited

U.S. PATENT DOCUMENTS 5,748,866 A * 5/1998 Edgar ..... 345/428
8,117,554 B1 * 2/2012 Grechishkin et al. ..... 715/764

(Continued)

FOREIGN PATENT DOCUMENTS

JP 2004-336317 A 11/2004
KR 10-2009-0073750 A 7/2009

(Continued)

OTHER PUBLICATIONS

Jeff Sharkey, Android SurfaceFlinger tricks for fun and profit Thursday Jul. 1, 2010 [online][Retrieved from: http://jsharkey.org/blog/2010/07/01/android-surfaceflinger-tricks-for-fun-and-profit/] [Retrieved on: Dec. 11, 2014 11:48:48 AM].*

(Continued)

*Primary Examiner* — Sultana M Zalalee
(74) *Attorney, Agent, or Firm* — Birch, Stewart, Kolasch & Birch, LLP

(57) ABSTRACT

This specification relates to a mobile terminal capable of being compatible with market applications with various LCD resolutions, and an LCD resolution compatibility method thereof. When resolution of a market application is different from LCD resolution, the application image is displayed on a window based on virtual WVGA resolution and then enlarged or reduced based on an actual LCD resolution to be finally displayed on a display unit. This provides an effect of displaying the application image with the same figure as displayed on the WVGA LCD and text and lines more clearly irrespective of an actual LCD size. In addition, a set value for a resolution compatibility mode of an application downloaded from a market may be provided to a user at a specific time point (upon downloading or purchasing), based on usage patterns of a plurality of users and versions of applications.

22 Claims, 16 Drawing Sheets

(56) References Cited

U.S. PATENT DOCUMENTS

| | | | | |
|---|---|---|---|---|
| 8,516,308 | B1 * | 8/2013 | Gill et al. | 714/38.1 |
| 2003/0063120 | A1 * | 4/2003 | Wong et al. | 345/746 |
| 2005/0017994 | A1 * | 1/2005 | Oh | G09G 3/3406 345/691 |
| 2007/0157234 | A1 * | 7/2007 | Walker | 725/38 |
| 2009/0213273 | A1 * | 8/2009 | Michel et al. | 348/714 |
| 2011/0072380 | A1 | 3/2011 | Jang | |

FOREIGN PATENT DOCUMENTS

| | | | |
|---|---|---|---|
| KR | 10-2010-0059568 | A | 6/2010 |
| KR | 10-2011-0032678 | A | 3/2011 |

OTHER PUBLICATIONS

Samsung, Dec. 10, 2014 [online] [retrieved from: http://www.newegg.com/Product/Product.aspx?Item=N82E16834131763] [retrieved on Dec. 10, 2014 7:35:28 PM].*

Android Developers, "graphics", Jul. 11, 2011, [online][Retrieved from: http://source.android.com/devices/graphics/index.html] [Retrieved on:Dec. 11, 2014 11:51:16 AM].*

Scott Main, New Mode for Apps on Large Screens, Jul. 11, 2011 [online] [retrieved from: http://android-developers.blogspot.com/2011/07/new-mode-for-apps-on-large-screens.html] [retrieved on:Dec. 2, 2014 3:16:04 PM].*

Brink, How to Run a Program in Compatibility Mode in Windows 7, Nov. 4, 2008 [online] [retrieved from: http://www.sevenforums.com/tutorials/316-compatibility-mode.html] [retrieved on:Nov. 15, 2015].*

Android Developers, "Android Compatibility," XP002690743, URL:http://www.cangelis.com/dosyalar/andoid_sdk_best_practices.pdf, Jul. 9, 2010, 87 pages.

J. Wilcox, "Google Issues Temporary Fix for the There Aren't Enough Native Honeycomb Appe",XP002690742, URL:http://betanews.com/2011/07/18/google-issues-temporary-fix-for-th-there-aren-t-enough-native-honeycomb-apps-problem/, Jul. 18, 2011, 4 pages.

T. Bray, "New Mode for Apps on Large Screens," XP002690741, URL:http://android-developers.blogspot.nl/2011/07/new-mod-for-apps-on-large-screens.html, Jul. 11, 2011, 2 pages.

* cited by examiner

UNCLEAR LETTERS CLEAR LETTERS

ABNORMAL SCREEN NORMAL SCREEN

MOBILE TERMINAL AND RESOLUTION COMPATIBILITY METHOD THEREOF

CROSS-REFERENCE TO RELATED APPLICATION

Pursuant to 35 U.S.C. §119(a), this application claims the benefit of earlier filing date and right of priority to Korean Application Nos. 10-2011-0096580, filed on Sep. 23, 2011, and 10-2012-0056271, filed on May 25, 2012, the contents of all these applications are incorporated by reference herein in their entirety.

BACKGROUND OF THE INVENTION

1. Field of the Invention

This specification relates to a mobile terminal capable of being compatible with market applications having resolutions of various sizes of LCDs, and an LCD resolution compatibility method thereof.

2. Background of the Invention

Mobile terminals may be configured to perform various functions, for example, data and voice communication, capturing images or video, storing voice, reproducing music files via a speaker system, displaying images or video and the like. Some of mobile terminals may include an additional function of playing games, and other mobile terminals may be implemented as multimedia players. In addition, in recent time, mobile terminals can receive broadcast or multicast signals to allow viewing of video or television programs.

Furthermore, many efforts are undergoing to support or enhance various functions of such mobile terminals. Such many efforts include not only changes and improvement of structural components implementing a mobile terminal but also software or hardware improvement.

Among others, a touch function of the mobile terminal is designed for a user unfamiliar to button/key input using a touch screen to conveniently execute operations of the mobile terminal. In recent time, the touch function is becoming an important function of the terminal together with a user interface (UI), in addition to a simple input function. Hence, as the touch function is further applied to the mobile terminal in various forms, development of appropriate UIs is more needed.

In recent time, responding to mobile communication technologies and users' demands, mobile terminals having different types (sizes) of LCDs are being released. The types of LCDs include Quarter Video Graphic Array (QVGA) with resolution of 320×240, HalfVGA (HVGA) with resolution of 480×320, Wide VGA (WVGA) with resolution of 800×480, quarter High Definition (qHD) with resolution of 960×540, HD with resolution of 1920×1080, eXtended Graphics Array (XGA) with resolution of 1024×768, and the like. Among others, the QVGA has the lowest resolution and the XGA has the highest resolution.

Manufacturers of terminals or developers of applications have developed applications for mobile terminals or smart phones to be used for such various types of LCDs. This trend gives rise to various changes in applications, from applications for an existing WVGA only to applications for HD, XGA, HVGA, QVGA and the like.

However, the manufactures of terminals suffer from an increase in development costs when applications are developed for each type of LCD in consideration of various LCD sizes. To overcome the disadvantage, terminal manufactures first develop an application for WVGA, and refactor the application using a multi-screen function to apply to other types of LCDs. However, this also requires to develop a separate application for each type of LCD (LCD resolution) because many incompatible LCDS are present.

In addition, with the increase in the spread of smart phones in recent time, users download their desired paid or free applications from markets to use in their own terminals or smart phones. However, when an application downloaded from a market is not properly executed (displayed) due to being incompatible with a user's terminal, for example, LCD of HD phone, the user may feel that the HD phone or the application has a problem. This situation results in lowering reliability for the product (mobile terminal or application). Consequently, it may be worked as a severe restriction at the moment when the user selects an LCD of a new product later (for example, upon purchasing a new terminal).

To overcome the shortcomings, a resolution compatibility mode (or compatibility mode), in which an application supporting a specific resolution is able to be displayed at a different resolution without a screen broken, is used in mobile terminals.

However, most of users are not aware of a function of setting the resolution compatibility mode. Especially, the resolution compatibility mode is set to "Off" as a default value. If an application with an incompatible resolution is displayed, a user may view a broke screen at least one time.

Therefore, when the broken screen is displayed due to the difference of resolution, the user suffers from changing the compatibility mode setting from "Off" to "On" one by one after entrance into a display settings menu.

In addition, upon execution of another application after changing the compatibility mode into "On", when the corresponding application is upgraded to support several resolutions, the compatibility mode may disadvantageously remain in the "On" state, in spite of no need to set the mode to "On".

Therefore, in the related art, the On/Off decision with respect to the resolution compatibility mode is manually performed individually based on a user's determination. This causes a trouble in ensuring compatibility of the resolution for each application.

SUMMARY OF THE INVENTION

Therefore, to address the shortcomings of the related art, an aspect of the detailed description is to provide a mobile terminal capable of ensuring compatibility of Liquid Crystal Display (LCD) resolution for various types of applications, and a resolution compatibility method thereof.

Another aspect of the detailed description is to provide a mobile terminal capable of automatically executing setting of a resolution compatibility mode, and a resolution compatibility method thereof.

Another aspect of the detailed description is to provide a mobile terminal capable of executing setting of a compatibility mode based on a user's usage pattern, and a resolution compatibility method thereof.

To achieve these and other advantages and in accordance with the purpose of this specification, as embodied and broadly described herein, there is provided a resolution compatibility method for a mobile terminal according to a first exemplary embodiment including checking a set state of a resolution compatibility mode upon execution of a market application, drawing an image of the market application at a virtual resolution when the resolution compatibility mode has been set, enlarging or reducing the drawn virtual image of the market application based on an actual LCD resolution, and displaying the enlarged or reduced market application image on a display unit.

The resolution of the market application may be different from the actual LCD resolution.

The virtual resolution may be one of Half VGA (HVGA), High Definition (HD) and eXtended Graphics Array (XGA), and the actual LCD resolution may include HVGA resolution, HD resolution and XGA resolution.

The method may further include selecting a specific virtual standard resolution and a market application in the resolution compatibility mode.

The virtual market application image may be drawn on a window and then enlarged on a canvas.

In accordance with a second exemplary embodiment, there is provided a resolution compatibility method for a mobile terminal including downloading an application from a market, receiving an optimal set value of a resolution compatibility mode with respect to the downloaded application from a server, and displaying the application by executing the resolution compatibility mode based on the received optimal set value.

The resolution compatibility mode of the application may be in a state set to "optimal" upon downloading the application.

The optimal set value may be requested as a background for reception.

The optimal set value may be a set value with respect to the resolution compatibility mode that users have the most frequently set for the corresponding application, or a set value decided based on an application version.

The optimal set value may be decided by giving a different weight for each user or according to a time point that the user sets the value.

To achieve these and other advantages and in accordance with the purpose of this specification, as embodied and broadly described herein, there is provided a mobile terminal in accordance with a first exemplary embodiment including a memory configured to store at least one market application, a display unit configured to display the market application, and a controller configured to draw an image of the market application at a virtual resolution according to setting of a resolution compatibility mode when the corresponding market application is executed, and thereafter enlarge or reduce the drawn market application image based on an actual LCD resolution to display on the display unit.

The resolution of the market application may be different from the actual LCD resolution.

The virtual resolution may be one of Half VGA (HVGA), High Definition (HD) and eXtended Graphics Array (XGA), and the actual LCD resolution may include HVGA resolution, HD resolution and XGA resolution.

The setting of the resolution compatibility mode may include a specific virtual standard resolution and a market application.

The virtual market application image may be drawn on a window and then enlarged on a canvas.

The controller may include a surface flinger configured to request LCD information from an Android framework when the market application is executed, so as to draw an image of the market application based on a virtual resolution provided from the Android framework, and an Android framework configured to provide the virtual resolution to the surface flinger, when the resolution compatibility mode has been set, in response to the request for the LCD information from the surface flinger.

In accordance with a second exemplary embodiment, there is provided a mobile terminal including a memory, a display unit, and a controller configured to receive an optimal set value of a resolution compatibility mode from a server upon downloading an application from a market, execute the resolution compatibility mode based on the received optimal set value, and display the downloaded application on the display unit.

The resolution compatibility mode of the application may in a state set to "optimal" upon downloading the application.

The controller may request the optimal set value as a background for reception.

The server may decide and manage the optimal set value based on a set value of the resolution compatibility mode that users have the most frequently set for the market application, or an application version.

The server may give a different weight for each user or according to a time point that the user sets the value upon deciding the optimal set value.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of mobile terminals according to the present invention, with reference to the accompanying drawings. Hereinafter, suffixes "module" and "unit or portion" for components used herein in description are merely provided only for facilitation of preparing this specification, and thus they are not granted a specific meaning or function. Hence, it should be noticed that "module" and "unit or portion" can be used together.

Mobile terminals may be implemented using a variety of different types of terminals. Examples of such terminals include mobile terminals, such as mobile phones, smart phones, notebook computers, digital broadcast terminals, Personal Digital Assistants (PDA), Portable Multimedia Players (PMP), navigators and the like, and stationary terminals, such as digital TVs, desktop computers and the like. The following description assumes that the terminal is a mobile terminal. However, it can be easily understood by those skilled in the art that the configuration according to the following description can be applied to the stationary terminals except for components particularly provided for mobility.

Figure 1:
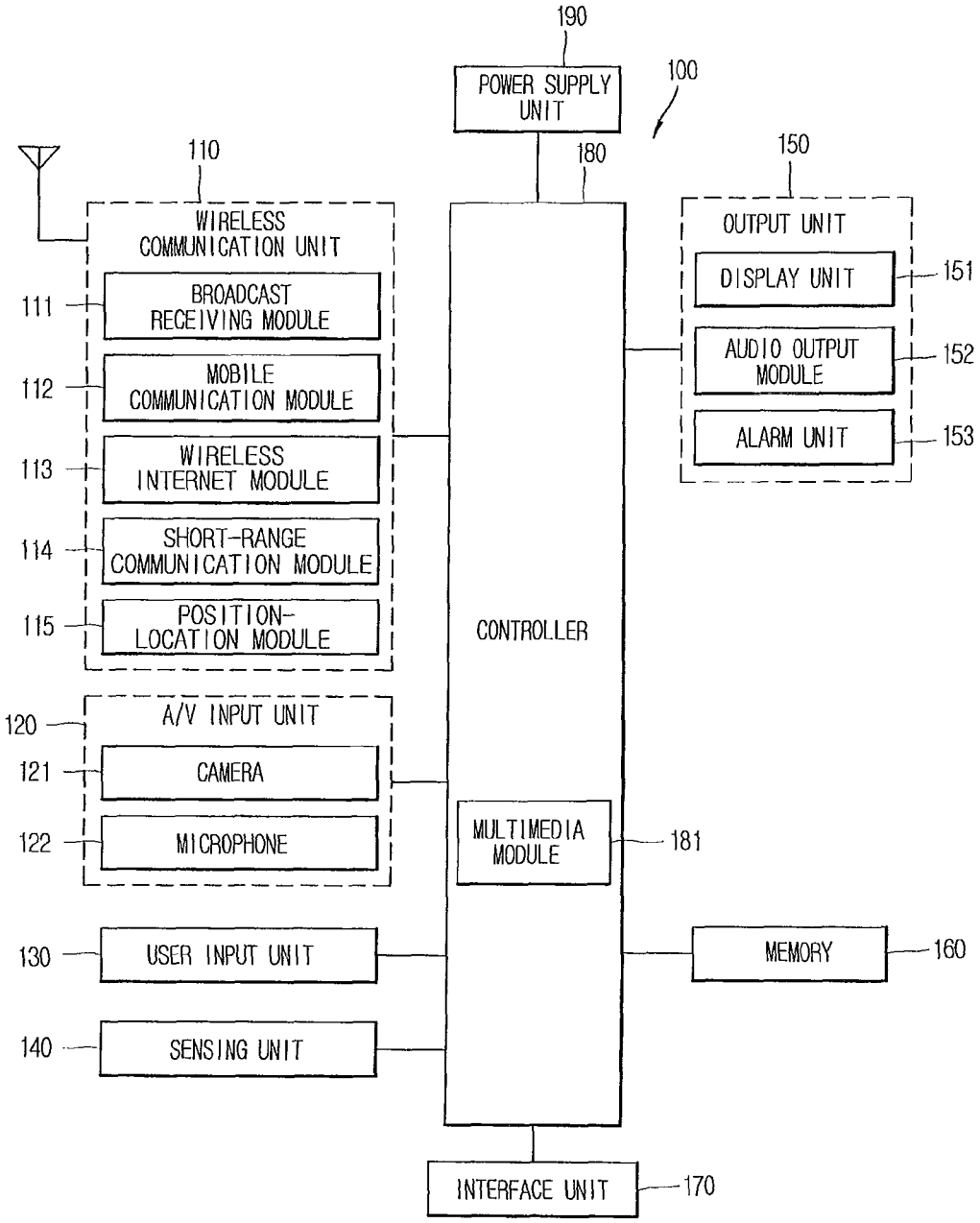
FIG. 1 is a block diagram of a mobile terminal in accordance with one exemplary embodiment of this specification.

FIG. 1 is a block diagram of a mobile terminal in accordance with one embodiment of the present invention.

The mobile terminal 100 may comprise components, such as a wireless communication unit 110, an Audio/Video (A/V) input unit 120, a user input unit 130, a sensing unit 140, an output unit 150, a memory 160, an interface unit 170, a controller 180, a power supply 190 and the like. FIG. 1 shows the mobile terminal 100 having various components, but it is understood that implementing all of the illustrated components is not a requirement. Greater or fewer components may alternatively be implemented.

Hereinafter, each component is described in sequence.

The wireless communication unit 110 may typically include one or more components which permit wireless communications between the mobile terminal 100 and a wireless communication system or between the mobile terminal 100 and a network within which the mobile terminal 100 is located. For example, the wireless communication unit 110 may include a broadcast receiving module 111, a mobile communication module 112, a wireless internet module 113, a short-range communication module 114, a position location module 115 and the like.

The broadcast receiving module 111 receives a broadcast signal and/or broadcast associated information from an external broadcast managing entity via a broadcast channel. The broadcast channel may include a satellite channel and a terrestrial channel. The broadcast managing entity may indicate a server which generates and transmits a broadcast signal and/or broadcast associated information or a server which receives a pre-generated broadcast signal and/or broadcast associated information and sends them to the mobile terminal. Examples of broadcast associated information may include information associated with a broadcast channel, a broadcast program, a broadcast service provider, and the like. The broadcast signal may be implemented as a TV broadcast signal, a radio broadcast signal, and a data broadcast signal, among others. The broadcast signal may further include a data broadcast signal combined with a TV or radio broadcast signal.

The broadcast associated information may indicate information related to a broadcast channel, a broadcast program or a broadcast service provider. The broadcast associated information may be provided via a mobile communication network, and received by the mobile communication module 112.

The broadcast associated information may be implemented in various formats. For instance, broadcast associated information may include Electronic Program Guide (EPG) of Digital Multimedia Broadcasting (DMB), Electronic Service Guide (ESG) of Digital Video Broadcast-Handheld (DVB-H), and the like.

The broadcast receiving module 111 may be configured to receive digital broadcast signals transmitted from various types of broadcast systems. Such broadcast systems may include Digital Multimedia Broadcasting-Terrestrial (DMB-T), Digital Multimedia Broadcasting-Satellite (DMB-S), Media Forward Link Only (MediaFLO), Digital Video Broadcast-Handheld (DVB-H), Integrated Services Digital Broadcast-Terrestrial (ISDB-T), and the like. The broadcast receiving module 111 may be configured to be suitable for every broadcast system transmitting broadcast signals as well as the digital broadcasting systems.

Broadcast signals and/or broadcast associated information received via the broadcast receiving module 111 may be stored in a suitable device, such as a memory 160.

The mobile communication module 112 transmits/receives wireless signals to/from at least one of network entities (e.g., base station, an external mobile terminal, a server, etc.) on a mobile communication network. Here, the wireless signals may include audio call signal, video call signal, or various formats of data according to transmission/reception of text/multimedia messages.

The wireless internet module 113 supports wireless Internet access for the mobile terminal. This module may be internally or externally coupled to the mobile terminal. Examples of such wireless Internet access may include Wireless LAN (WLAN), Wi-Fi, Wireless Broadband (Wibro), World Interoperability for Microwave Access (Wimax), High Speed Downlink Packet Access (HSDPA), and the like.

The short-range communication module 114 denotes a module for short-range communications. Suitable technologies for implementing this module may include BLUETOOTH, Radio Frequency IDentification (RFID), Infrared Data Association (IrDA), Ultra-WideBand (UWB), ZigBee, and the like.

The position location module 115 denotes a module for detecting or calculating a position of a mobile terminal. An example of the position location module 115 may include a Global Position System (GPS) module. Under the current technique, the GPS module can measure accurate time and distance respectively from more than three satellites so as to accurately calculate a current position of the mobile terminal based on such three different distances according to a triangulation scheme. A scheme may be used to obtain time information and distance information from three satellites and correct error by one satellite. Also, the GPS module may continuously calculate a current position in real time so as to obtain speed information.

The A/V input unit 120 is configured to provide audio or video signal input to the mobile terminal. The A/V input unit 120 may include a camera 121 and a microphone 122. The camera 121 receives and processes image frames of still pictures or video obtained by image sensors in a video call mode or a capturing mode. The processed image frames may be displayed on a display 151.

The image frames processed by the camera 121 may be stored in the memory 160 or transmitted to the exterior via the wireless communication unit 110. Two or more cameras 121 may be provided according to the configuration of the mobile terminal.

The microphone 122 may receive an external audio signal via a microphone while the mobile terminal is in a particular mode, such as a phone call mode, a recording mode, a voice recognition mode, or the like. This audio signal is processed into digital data. The processed digital data is converted for output into a format transmittable to a mobile communication base station via the mobile communication module 112 in case of the phone call mode. The microphone 122 may include assorted noise removing algorithms to remove noise generated in the course of receiving the external audio signal.

The user input unit 130 may generate input data inputted by a user to control the operation of the mobile terminal. The user input unit 130 may include a keypad, a dome switch, a touchpad (e.g., static pressure/capacitance), a jog wheel, a jog switch and the like. A specific example can be one in which the touchpad is layered with the display 151 to be explained later so as to be in cooperation with the display 151, which is referred to as a touch screen.

The sensing unit 140 provides status measurements of various aspects of the mobile terminal. For instance, the sensing unit 140 may detect an open/close status of the mobile terminal, a change in a location of the mobile terminal 100, a presence or absence of user contact with the mobile terminal 100, the location of the mobile terminal 100, acceleration/deceleration of the mobile terminal 100, and the like, so as to generate a sensing signal for controlling the operation of the mobile terminal 100. For example, regarding a slide-type mobile terminal, the sensing unit 140 may sense whether a sliding portion of the mobile terminal is open or closed. Other examples include sensing functions, such as the sensing unit 140 sensing the presence or absence of power provided by the power supply 190, the presence or absence of a coupling or other connection between the interface unit 170 and an external device, and the like. Here, the sensing unit 140 may include a proximity sensor 141, which will be described later in relation to a touch screen.

The sensing unit 140 includes a geomagnetic sensor to calculate a moving direction when a user moves, a gyro sensor to calculate a rotating direction, and an acceleration sensor.

The interface unit 170 is generally implemented to couple the mobile terminal to external devices. The interface unit 170 may include, for example, wired/wireless headset ports, external charger ports, wired/wireless data ports, memory card ports, ports for coupling devices having an identification module, etc.), audio Input/Output (I/O) ports, video I/O ports, earphone ports, and the like.

The identification module may be configured as a chip for storing various information required to authenticate an authority to use the mobile terminal 100, which may include a User Identity Module (UIM), a Subscriber Identity Module (SIM), a Universal Subscriber Identity Module (USIM), and the like. Also, the device having the identification module (hereinafter, referred to as "identification device") may be implemented in a type of smart card. Hence, the identification device can be coupled to the mobile terminal 100 via a port. Such interface unit 170 may receive data from an external device, or provided with power and accordingly transfer the received data or power to each component within the mobile terminal 100 or transfer data of the mobile terminal 100 to an external device.

Also, the interface unit 170 may serve as a path for power to be supplied from an external cradle to the mobile terminal 100 when the mobile terminal 100 is connected to the external cradle or as a path for transferring various command signals inputted from the cradle by a user to the mobile terminal 100. Such various command signals or power inputted from the cradle may operate as signals for recognizing that the mobile terminal 100 has accurately been mounted to the cradle.

The output unit 150 is configured to output an audio signal, a video signal or an alarm signal. The output unit 150 may include a display 151, an audio output module 152, an alarm 153, and the like.

The display 151 may output information processed in the mobile terminal 100. For example, when the mobile terminal is operating in a phone call mode, the display 151 will provide a User Interface (UI) or a Graphic User Interface (GUI) which includes information associated with the call.

Meanwhile, as mentioned above, a touch screen can be configured as the display 151 and the touchpad are layered with each other to work in cooperation with each other. This configuration permits the display 151 to function both as an input device and as an output device. The display 151 may be implemented using, for example, a Liquid Crystal Display (LCD), a Thin Film Transistor-Liquid Crystal Display (TFT-LCD), an Organic Light-Emitting Diode (OLED), a flexible display, a three-dimensional (3D) display, or the like. Some of the displays can be configured to be transparent such that it is possible to see the exterior therethrough. These displays may be called transparent displays. A representative example of the transparent display may include a Transparent Organic Light Emitting Diode (TOLED), and the like. The mobile terminal 100 may include two or more of such displays 151 according to its embodiment. For example, the mobile terminal 100 may simultaneously include an external display (not shown) and an internal display (not shown). The touch screen may be configured so as to detect a touch input pressure as well as touch input position and touch input area.

The audio output module 152 may output audio data which is received from the wireless communication unit 110 in various modes including call-receiving mode, call-placing mode, recording mode, voice recognition mode, broadcast reception mode, and the like, or audio data stored in the memory 160. Also, the audio output module 152 may output an audio signal relating to a particular function (e.g., call received, message received, etc.) performed in the mobile terminal 100. The audio output module 152 may be implemented using a speaker, a buzzer, or the like.

The alarm unit 153 outputs signals notifying occurrence of events from the mobile terminal 100. The events occurring from the mobile terminal 100 may include call received, message received, key signal input, touch input, and so on. The alarm unit 153 may output not only video or audio signals, but also other types of signals such as signals notifying occurrence of events in a vibration manner. When a call signal or a message is received, the alarm unit 153 may output vibration to make a user recognize the event occurrence. Of course, the signal for notifying the event occurrence may be output through the display unit 151 or the audio output module 152.

The memory 160 may store a program for the processing and control of the controller 180. Alternatively, the memory 160 may temporarily store input/output data (e.g., phonebook data, messages, still images, video and the like). Also, the memory 160 may store data related to various patterns of vibrations and audio output upon the touch input on the touch screen.

The memory 160 may be implemented using any type of suitable storage medium including a flash memory type, a hard disk type, a multimedia card micro type, a memory card type (e.g., SD or DX memory), Random Access Memory (RAM), Static Random Access Memory (SRAM), Read-Only Memory (ROM), Electrically Erasable Programmable Read-only Memory (EEPROM), Programmable Read-only Memory (PROM), magnetic memory, magnetic disk, optical disk, and the like. Also, the mobile terminal 100 may operate a web storage which performs the storage function of the memory 160 on the Internet.

The controller 180 typically controls the overall operations of the mobile terminal 100. For example, the controller 180 performs the control and processing associated with telephony calls, data communications, video calls, and the like. The controller 180 may include a multimedia module 181 which provides multimedia playback. The multimedia module 181 may be configured as part of the controller 180 or as a separate component.

The controller 180 can perform a pattern recognition processing so as to recognize writing or drawing input on the touch screen as text or image.

The power supply 190 provides power required by various components under the control of the controller 180. The provided power may be internal power, external power, or combination thereof.

Various embodiments described herein may be implemented in a computer-readable medium using, for example, software, hardware, or some combination thereof.

For a hardware implementation, the embodiments described herein may be implemented within one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, microprocessors, other electronic units designed to perform the functions described herein, or a selective combination thereof. In some cases, such embodiments are implemented by the controller 180.

For software implementation, the embodiments such as procedures and functions may be implemented together with separate software modules each of which performs at least one of functions and operations. The software codes can be implemented with a software application written in any suitable programming language. Also, the software codes may be stored in the memory 160 and executed by the controller 180.

The mobile terminal 100 shown in FIG. 1 may be configured to operate within a communication system which transmits data via frames or packets, including both wireless and wireline communication systems, and satellite-based communication systems.

Hereinafter, description will be given of a communication system operable with a mobile terminal according to the present disclosure with reference to FIG. 2.

Such communication systems utilize different air interfaces and/or physical layers. Examples of such air interfaces utilized by the communication systems include Frequency Division Multiple Access (FDMA), Time Division Multiple Access (TDMA), Code Division Multiple Access (CDMA), and Universal Mobile Telecommunications System (UMTS), the Long Term Evolution (LTE) of the UMTS, the Global System for Mobile Communications (GSM), and the like. By way of non-limiting example only, further description will relate to a CDMA communication system, but such teachings apply equally to other system types including the CDMA wireless communication system.

Figure 2:
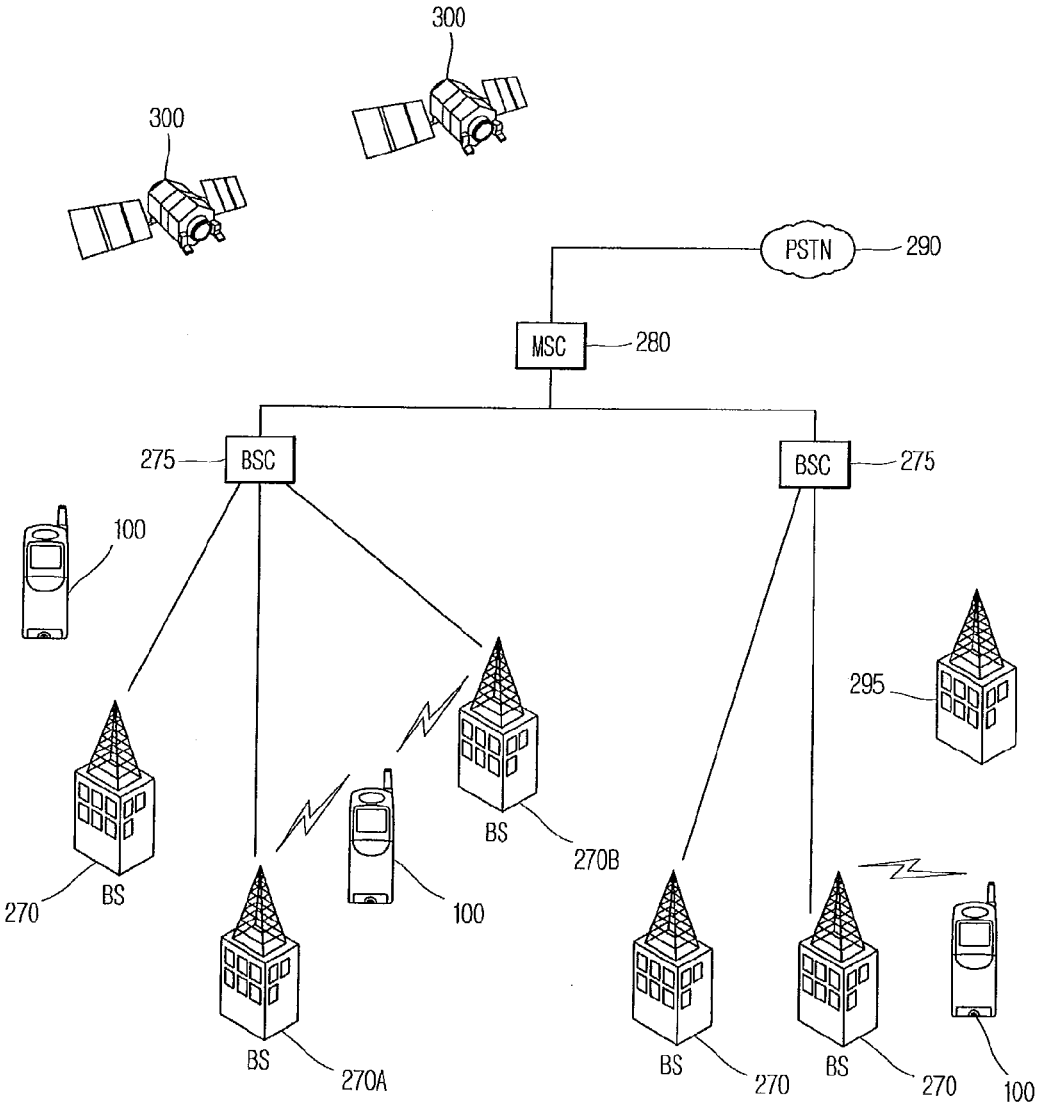
FIG. 2 is a diagram of a communication system operable with the mobile terminal.

Referring now to FIG. 2, a CDMA wireless communication system is shown having a plurality of mobile terminals 100, a plurality of base stations (BSs) 270, base station controllers (BSCs) 275, and a mobile switching center (MSC) 280. The MSC 280 is configured to interface with a conventional Public Switch Telephone Network (PSTN) 290. The MSC 280 is also configured to interface with the BSCs 275. The BSCs 275 are coupled to the base stations 270 via backhaul lines. The backhaul lines may be configured in accordance with any of several known interfaces including, for example, E1/T1, ATM, IP, PPP, Frame Relay, HDSL, ADSL, or xDSL. Hence, the plurality of BSCs 275 can be included in the system as shown in FIG. 2.

Each base station 270 may include one or more sectors, each sector having an omni-directional antenna or an antenna pointed in a particular direction radially away from the base station 270. Alternatively, each sector may include two or more different antennas. Each base station 270 may be configured to support a plurality of frequency assignments, with each frequency assignment having a particular spectrum (e.g., 1.25 MHz, 5 MHz, etc.).

The intersection of sector and frequency assignment may be referred to as a CDMA channel. The base stations 270 may also be referred to as Base Station Transceiver Subsystems (BTSs). In some cases, the term "base station" may be used to refer collectively to a BSC 275, and one or more base stations 270. The base stations may also be denoted as "cell sites." Alternatively, individual sectors of a given base station 270 may be referred to as cell sites.

A broadcasting transmitter (BT) 295, as shown in FIG. 2, transmits a broadcast signal to the mobile terminals 100 operating within the system. The broadcast receiving module 111 (FIG. 1) is typically configured inside the mobile terminal 100 to receive broadcast signals transmitted by the BT 295.

FIG. 2 further depicts several Global Positioning System (GPS) satellites 300. Such satellites 300 facilitate locating the position of at least one of plural mobile terminals 100. Two satellites are depicted in FIG. 2, but it is understood that useful position information may be obtained with greater or fewer satellites than two satellites. The GPS module 115 (FIG. 1) is typically configured to cooperate with the satellites 300 to obtain desired position information. It is to be appreciated that other types of position detection technology, (i.e., location technology that may be used in addition to or instead of GPS location technology) may alternatively be implemented. If desired, at least one of the GPS satellites 300 may alternatively or additionally be configured to provide satellite DMB transmissions.

During typical operation of the wireless communication system, the base stations 270 receive sets of reverse-link signals from various mobile terminals 100. The mobile terminals 100 are engaging in calls, messaging, and executing other communications. Each reverse-link signal received by a given base station 270 is processed within that base station 270. The resulting data is forwarded to an associated BSC 275. The BSC 275 provides call resource allocation and mobility management functionality including the orchestration of soft handoffs between base stations 270. The BSCs 275 also route the received data to the MSC 280, which then provides additional routing services for interfacing with the PSTN 290. Similarly, the PSTN 290 interfaces with the MSC 280, and the MSC 280 interfaces with the BSCs 275, which in turn control the base stations 270 to transmit sets of forward-link signals to the mobile terminals 100.

The present disclosure provides a resolution compatibility mode (function) applicable to an LCD (HVGA) with lower resolution as well as LCDs (HD, XGA) with higher resolution than an LCD whose resolution is not a standard resolution (or reference resolution), without modification (change, variation) of an application, by virtually providing the standard resolution on the LCD without having the standard resolution. The standard resolution is a resolution designated in mobile terminals. Hereinafter, WVGA resolution will be exemplarily described for the sake of explanation. The resolution compatibility mode may be set in a display setup menu of a user menu.

Figure 3:
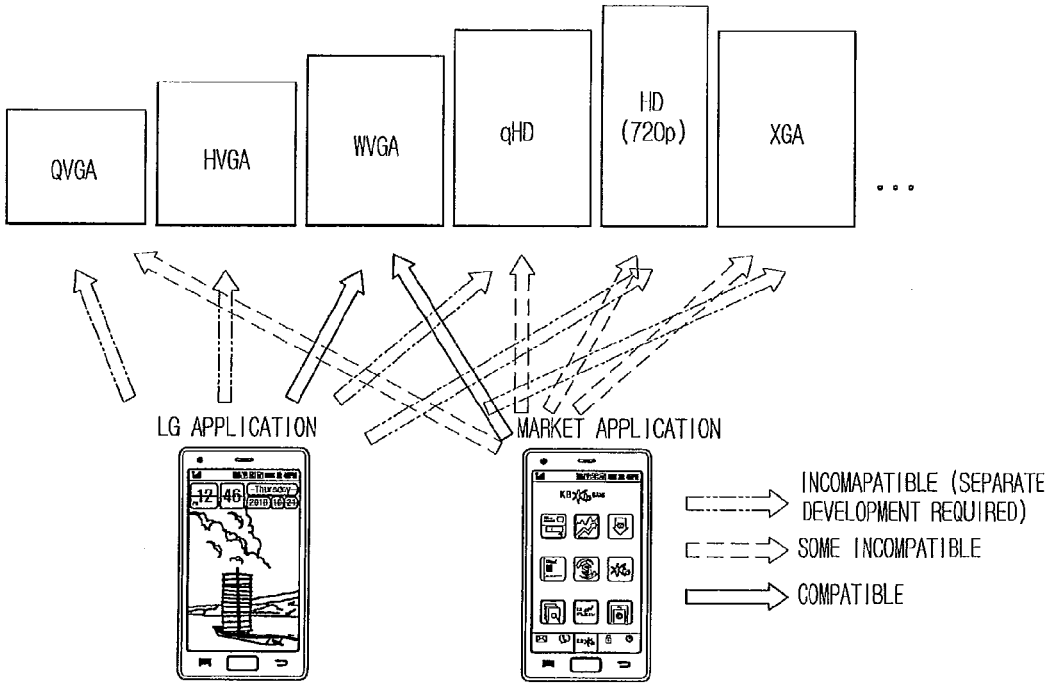
FIG. 3 is a view showing compatibility or incompatibility of applications for LCD types.

FIG. 3 is a view showing compatibility or incompatibility of applications for LCD types.

As shown in FIG. 3, with the diversification of LCD types, applications of terminal manufacturers supporting WVGA only and market applications are compatible with some LCDs but incompatible with most of LCDs in resolution. This requires to develop different applications for each of the incompatible LCD types (LCD resolution).

Figure 4:
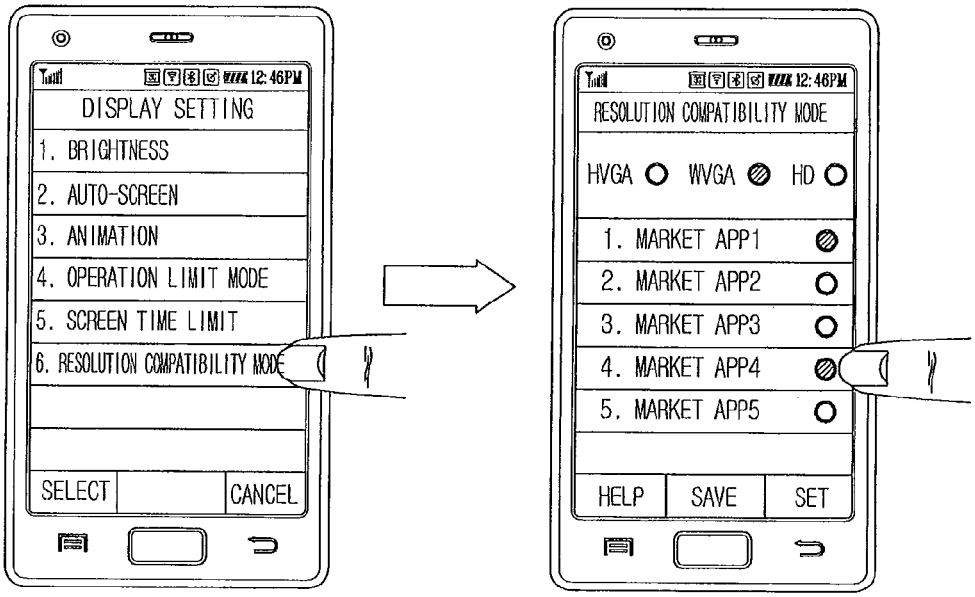
FIG. 4 is an exemplary view showing a process of setting a resolution compatibility mode in a user menu.

FIG. 4 is an exemplary view showing a process of setting a WVGA compatibility mode in a user menu.

As shown in FIG. 4, when a user selects a resolution compatibility mode in a display menu, a list containing a plurality of compatibility modes and a plurality of market applications may be displayed on a screen. When a specific compatibility mode (for example, WVGA compatibility mode) and specific market applications (for example, market App1 and market App4) are selected from the displayed list, the WVGA compatibility mode may be automatically applied when the corresponding market applications are executed later. Also, a compatibility mode setting item may not be displayed when a specific resolution is decided as a standard resolution.

Figure 5:
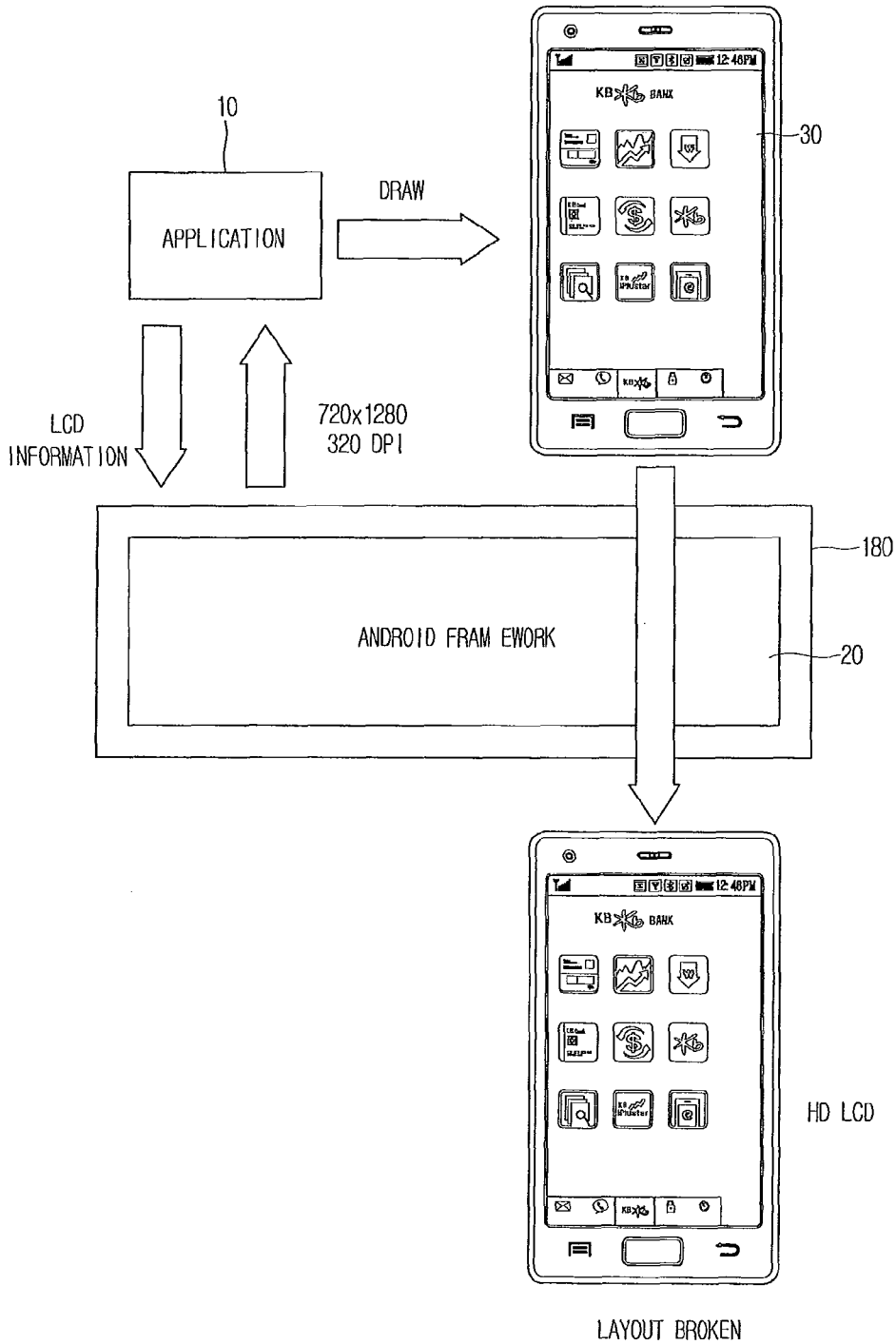
FIG. 5 is an exemplary view showing a process of displaying a market application on a screen when resolution of a market application is different from LCD resolution of the terminal according to the related art.

FIG. 5 is an exemplary view showing a process of displaying a market application on a screen when resolution of a market application is different from LCD resolution of the terminal according to the related art.

As shown in FIG. 5, when a specific application (market application) 10 with a WVGA resolution is executed, a surface flinger of the application 10 may request LCD information (resolution and DPI) of a mobile terminal from an Android framework 20. The Android framework 20 is a module for executing Android-based applications, and may be stored in the memory 160. The controller 180 may control the Android framework 20.

In response to the LCD information request, the Android framework 20 may inform the resolution of 720×1280 and 320 DPI to the surface flinger of the application 10 because the current mobile terminal has HD LCD. Upon reception of the LCD information from the Android framework 20, the surface flinger of the application 10 may draw (output, display) an image of the specific application 10 on 720×1280 window according to the corresponding LCD information (720×1280 and 320 DPI). The drawn image may eventually be displayed on the display 151, namely, the HD LCD of the mobile terminal.

However, since the specific application (market application) has the WVGA resolution, which is different from the resolution of the HD LCD, the WVGA application may be displayed on the HD LCD with its layout broken.

Figure 6:
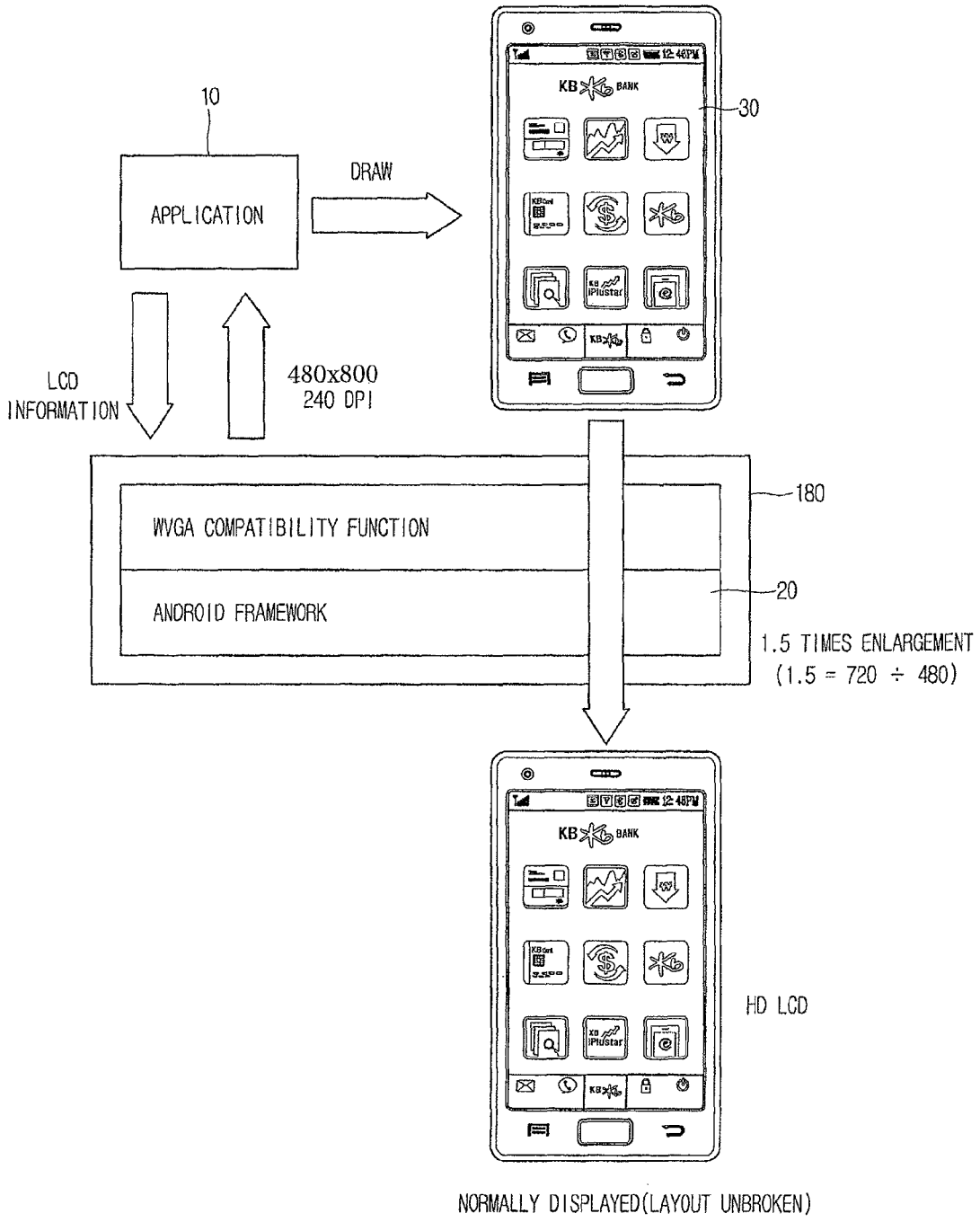
FIG. 6 is a view showing a resolution compatibility method in accordance with a first exemplary embodiment of the present disclosure.

FIG. 6 is a view showing a resolution compatibility method in accordance with an exemplary embodiment of the present disclosure.

As shown in FIG. 6, when a specific application (market application) 10 having WVGA resolution is executed, a surface flinger of the application 10 requests LCD information (resolution and DPI) of a mobile terminal from an Android framework 20.

In response to the LCD information request, the Android framework 20 may check whether or not a WVGA compatibility mode is in a set state, and if so, may inform to the surface flinger of the application 10 that the current LCD resolution of the mobile terminal is the WVGA resolution. That is, the Android framework 20 may provide 480×800 resolution and 240 DPI, other than 720×1280 resolution and 320 DPI, to the surface flinger of the application 10.

Upon reception of the WVGA resolution from the Android framework 20, the surface flinger of the application 10 may draw an image of the corresponding application on a window 30 of 480×800 other than 720×1280. Afterwards, the image drawn on the window 30 may be enlarged on a canvas (not shown) by 1.5 times to be changed into HD resolution, finally being displayed on the display unit 151, namely, HD LCD of the mobile terminal.

Therefore, even if the WVGA resolution of the market application 10 is different from the HD LCD resolution, the WVGA application may be normally displayed on the HD LCD with the layout unbroken.

Figure 7:
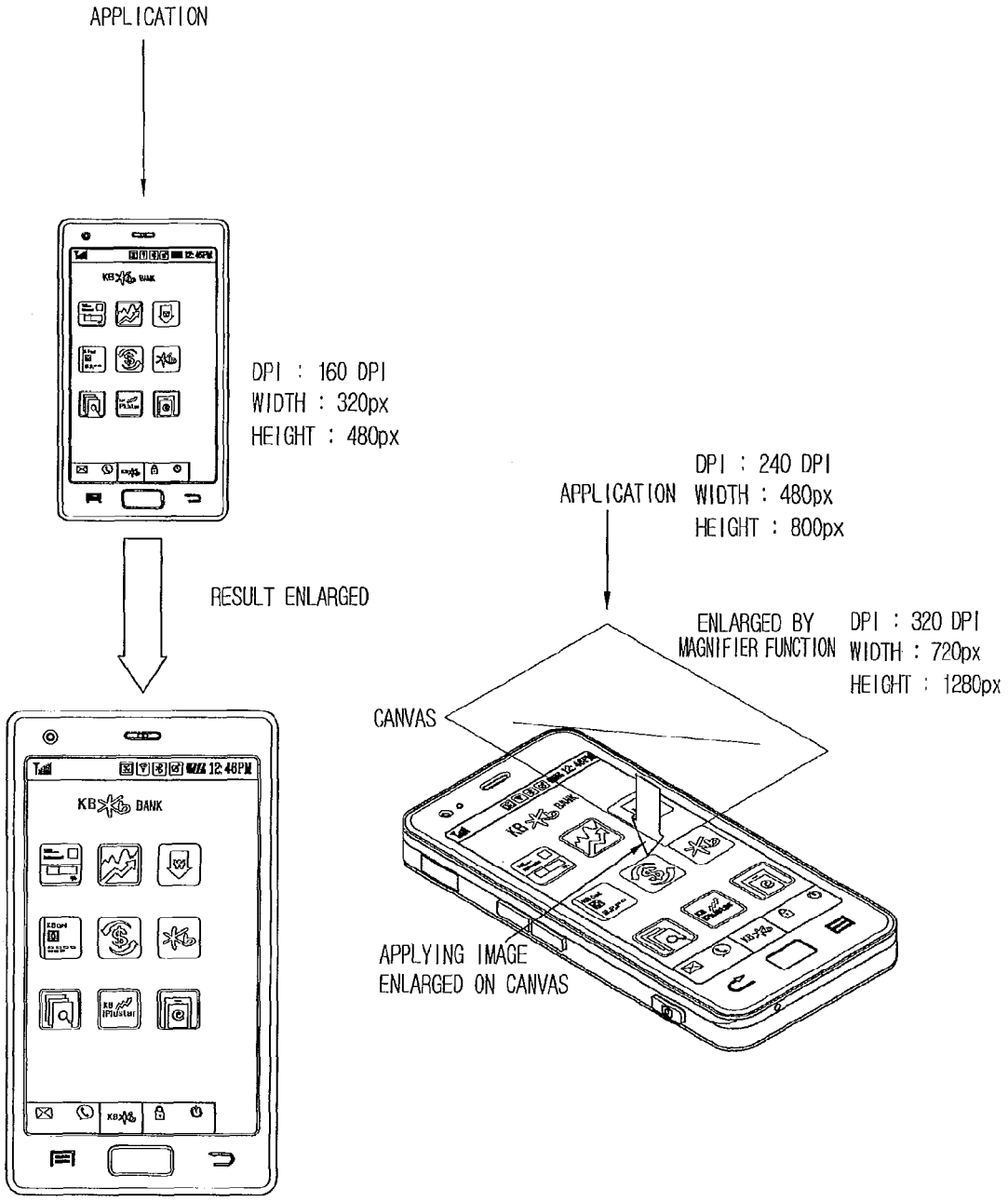
FIG. 7 is a conceptual view of enlarging an application image according to a resolution compatibility mode in the resolution compatibility method.

FIG. 7 is a conceptual view of enlarging an application image according to a resolution compatibility mode in the resolution compatibility method.

As shown in FIG. 7, when an application is finally displayed on the display unit 151 in the related art, it may be enlarged or reduced based on LCD resolution. On the contrary, according to the present disclosure, after displaying an application on a window based on virtual WVGA resolution, the application may be enlarged or reduced on a canvas based on actual LCD resolution, being displayed on the display unit 151.

Figure 8:
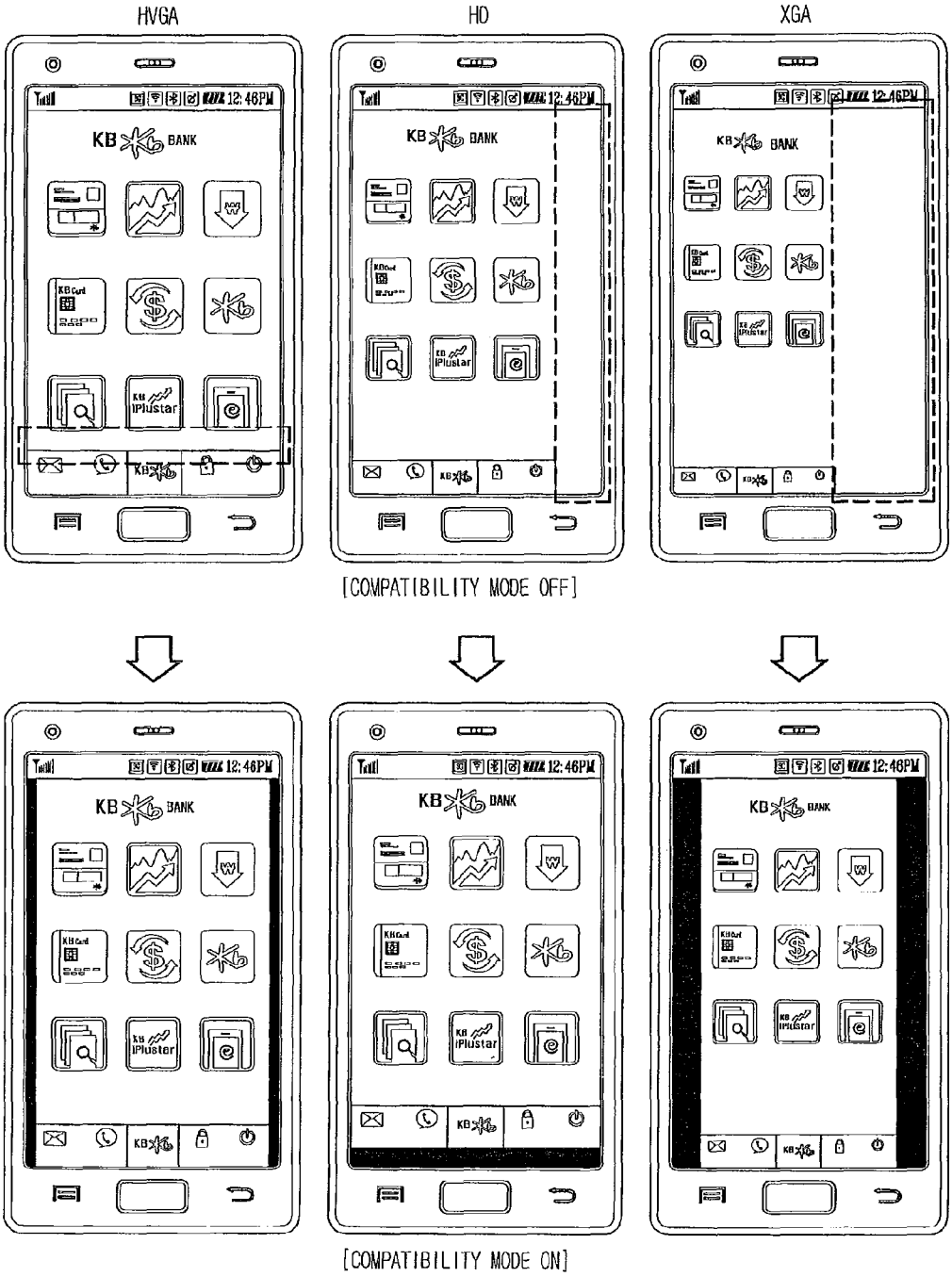
FIG. 8 is a comparative view of application images in a set state of WVGA compatibility mode and in a non-set state of the WVGA compatibility mode.

Therefore, as shown in FIG. 8, in a non-set state of the resolution compatibility mode, when the WVGA application is displayed on HVGA, HD or XGA, an image of the application may be inclined in a specific direction or overlapped or cut out by another image. However, as shown in the present disclosure, when the WVGA resolution is virtually provided on an LCD (HVGA, HD, or XGA) different from the WVGA LCD after setting the resolution compatibility mode, the image of the market application may be displayed with the same figure as being displayed on the WVGA LCD irrespective of an actual LCD size.

Figure 9A:
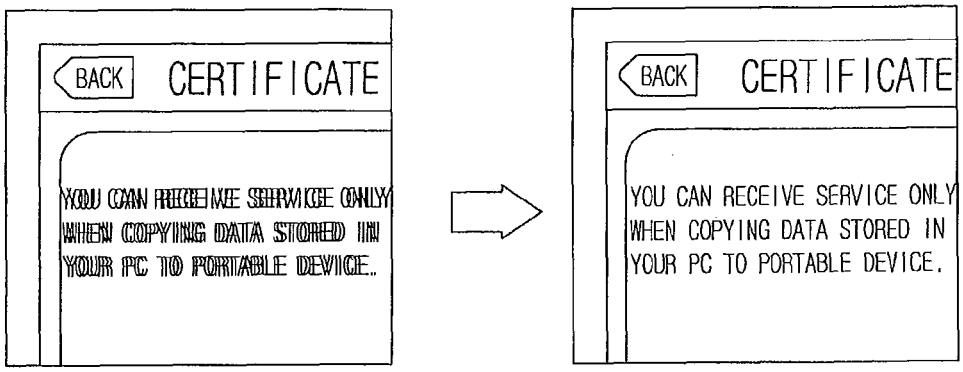
FIGS. 9A to 9C are views showing screen statuses upon applying the resolution compatibility method according to the present disclosure.
Figure 9B:
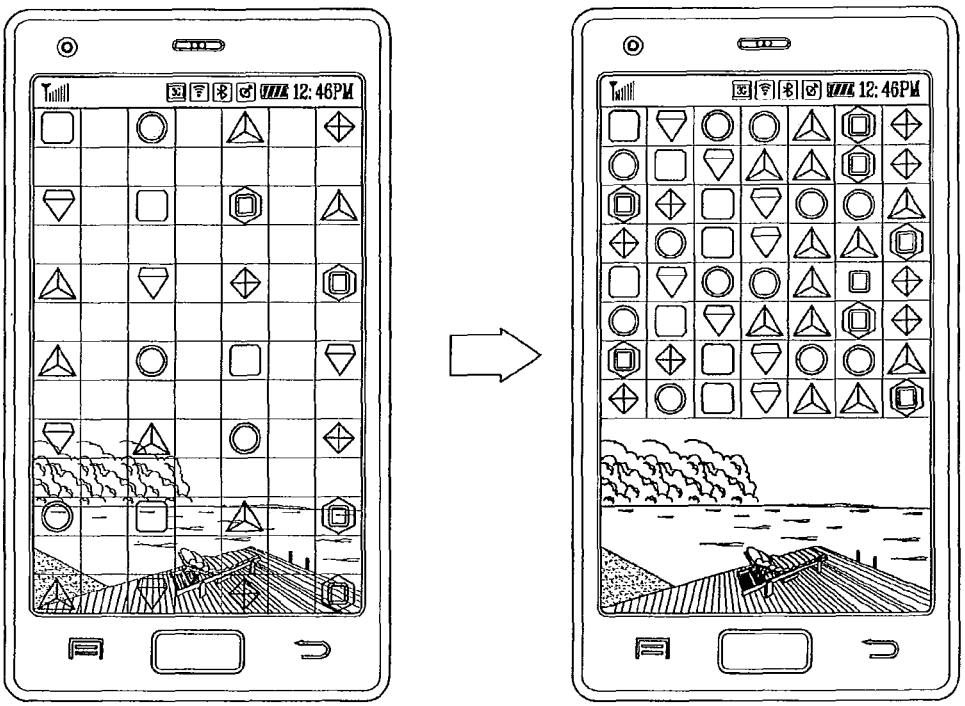
Figure 9C:
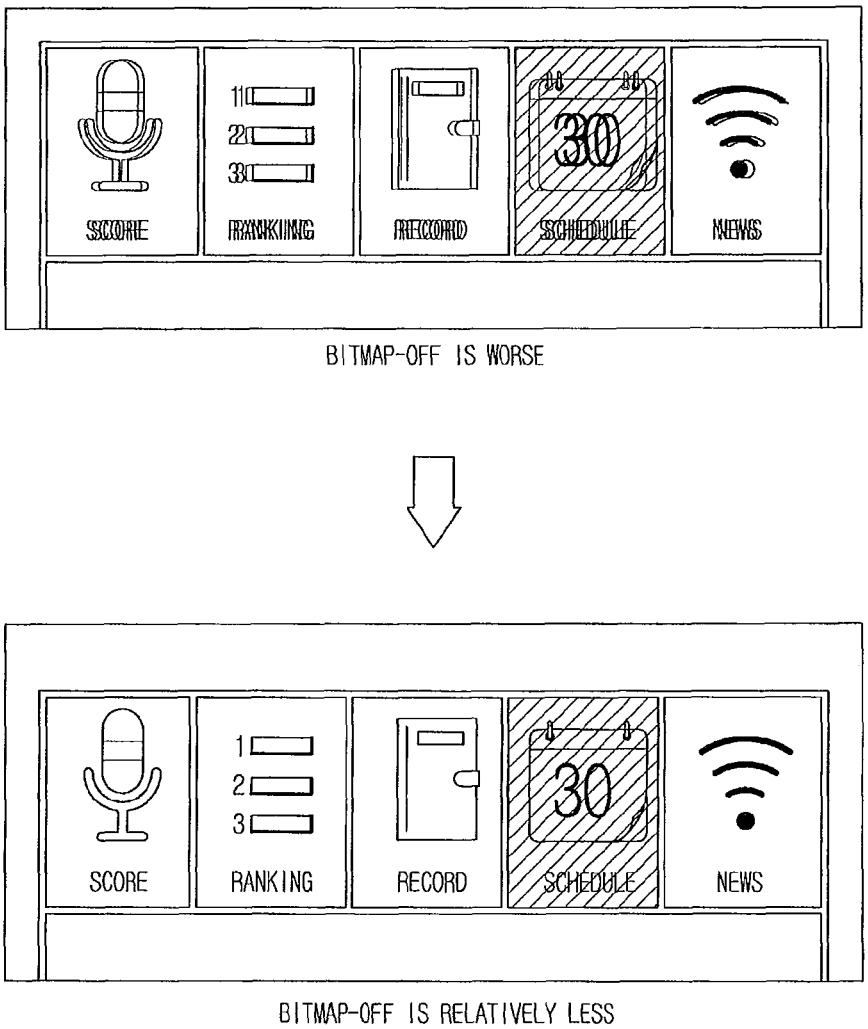

FIGS. 9A to 9C are views showing screen statuses upon applying the resolution compatibility method.

As shown in FIGS. 9A to 9C, upon applying an LCD resolution compatibility method according to the present disclosure, letters (characters), images, bitmap (line) and the like may be displayed more clearly than in the related art method. This is because the application image is first drawn on a canvas and then enlarged to be finally displayed, instead of enlarging the application image when finally displaying the application image on an LCD as done in the related art.

As such, the present disclosure may provide virtual WVGA resolution on an LCD (HVGA, HD, XGA, etc.) different from the WVGA. This may result in displaying an application image with the same figure as displayed on the WVGA LCD and text and lines more clearly irrespective of an actual LCD size.

Figure 10:
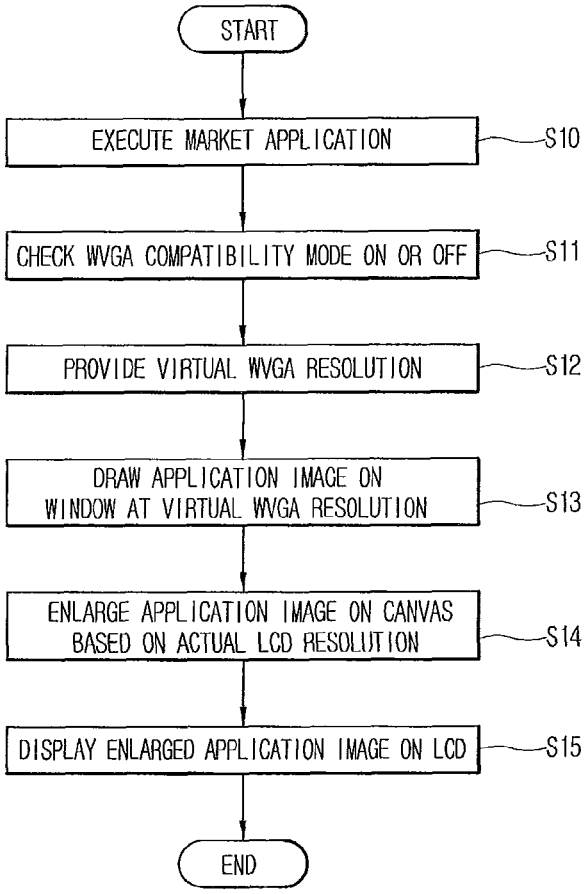
FIG. 10 is a flowchart showing a resolution compatibility method in accordance with a first exemplary embodiment.

FIG. 10 is a flowchart showing a resolution compatibility method in accordance with a first exemplary embodiment of the present disclosure. According to the present disclosure, an application is stored in the memory 160, an Android framework is included in the controller 180, and window and canvas are included in the display unit 151. Therefore, overall operations will be described based on the controller 180 and the display unit 151.

As shown in FIG. 10, when a specific market application stored in the memory 160 is executed (S10), the controller 180 may check a set state of a WVGA compatibility mode (S11). When it is checked that the WVGA compatibility mode is in a set state, the controller 180 may control the display unit 151 based on a virtual WVGA resolution provided from the Android framework (S12).

The display unit 151 may then display an image of the corresponding application (i.e., virtual application image) on the window at the virtual WVGA resolution provided from the controller 180, and thereafter enlarge the application image on the canvas based on the current LCD resolution of the mobile terminal, finally displaying the enlarged application image (S13 to S15).

The present disclosure has illustrated the WVGA resolution as the virtual resolution for the sake of explanation. The present invention may not be limited to that, but may obtain the same effect even if HVGA, HD or XGA resolution is set as the virtual resolution.

As another exemplary embodiment, the present disclosure may provide a resolution compatibility mode (function) capable of being applied even to an LCD (HVGA) with lower resolution as well as an LCD (HD, XGA) with higher resolution than an LCD whose resolution is not a standard (reference) resolution, without modification of an application, by automatically providing the standard resolution on the LCD without having the standard resolution according to a user's usage pattern or an application version.

FIG. 8 shows an example that an application with a specific resolution is displayed on an LCD with a different resolution according to setting of a resolution compatibility mode.

As shown in FIG. 8, in an Off state of the resolution compatibility mode (e.g., WVGA compatibility mode), when an application with WVGA resolution is displayed on an LCD having a different resolution, namely, on one of HVGA, HD and XGA, the application screen may be reduced by being inclined in a specific direction (e.g., for HD and XGA) or overlapped or cut off (e.g., for HVGA), namely, a kind of screen breaking may be caused.

In this state, when a user sets the resolution compatibility mode (e.g., from "Off" to "On"), the application may be displayed as like being displayed on a WVGA LCD, irrespective of the size (resolution) of the LCD, on which the application is currently displayed (i.e., the screen breaking is compensated for).

Figure 11:
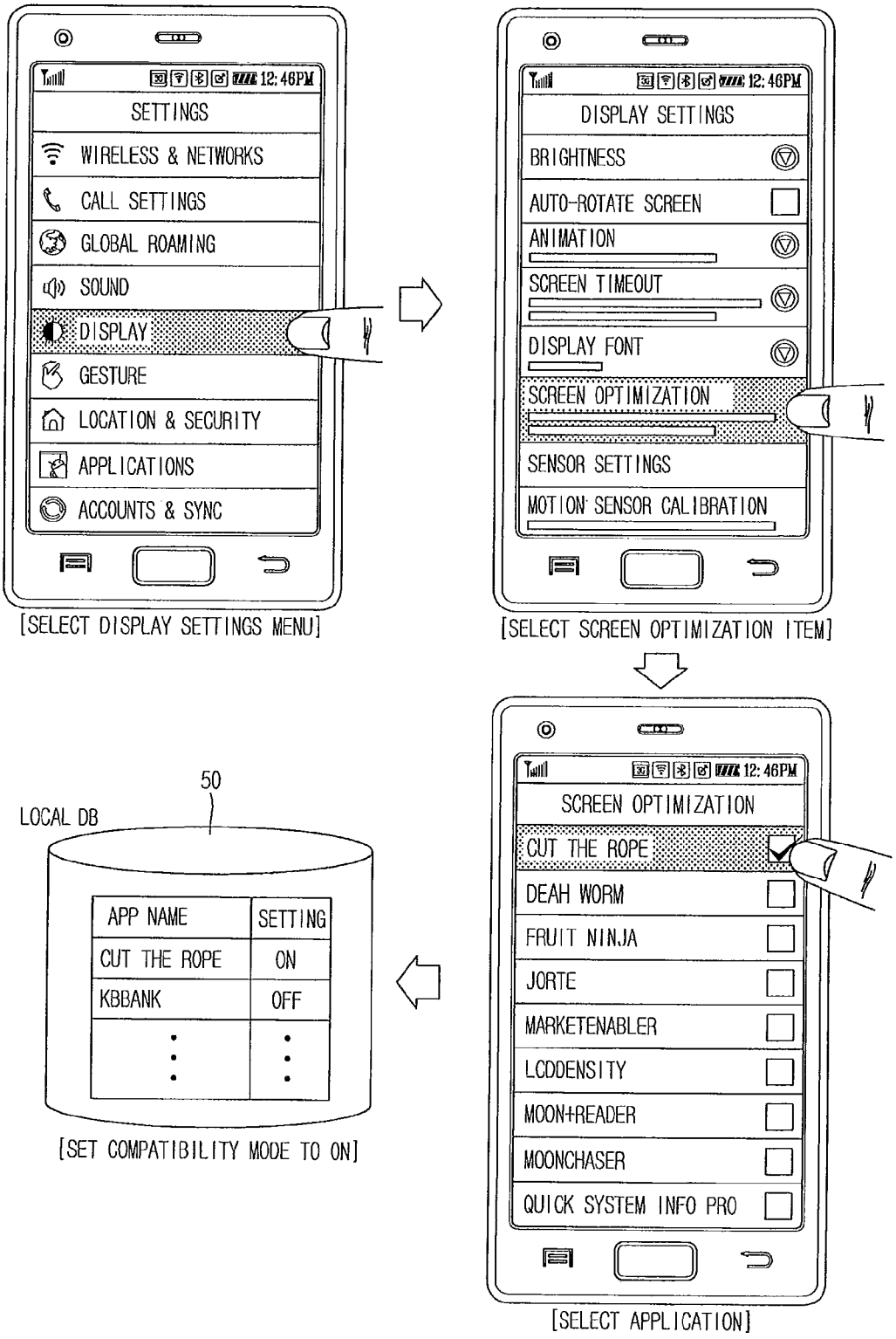
FIG. 11 is a view showing an example of setting a resolution compatibility mode through a display settings menu in a resolution compatibility method in accordance with the first exemplary embodiment.

FIG. 11 shows an example of setting a resolution compatibility mode through a display settings menu.

When an application, for example, "Cut the Rope", having a specific resolution (e.g., WVGS) is displayed on the mobile terminal, screen breaking may occur due to the difference of resolution.

To overcome the screen breaking, a user may select a display settings menu from a settings menu, and select a screen optimization item from the selected display settings menu. Upon selection of the screen optimization item, a list containing a plurality of applications (downloaded from the market) is displayed, accordingly, the user may select a desired application to set a resolution compatibility mode therefor. Information related to the application for which the resolution compatibility mode has been set may be stored in a logical database (DB) 50.

When the mobile terminal is rebooted after the resolution compatibility mode is set, the application with the WVGA resolution may be normally displayed even on an LCD with the HD resolution.

Figure 12:
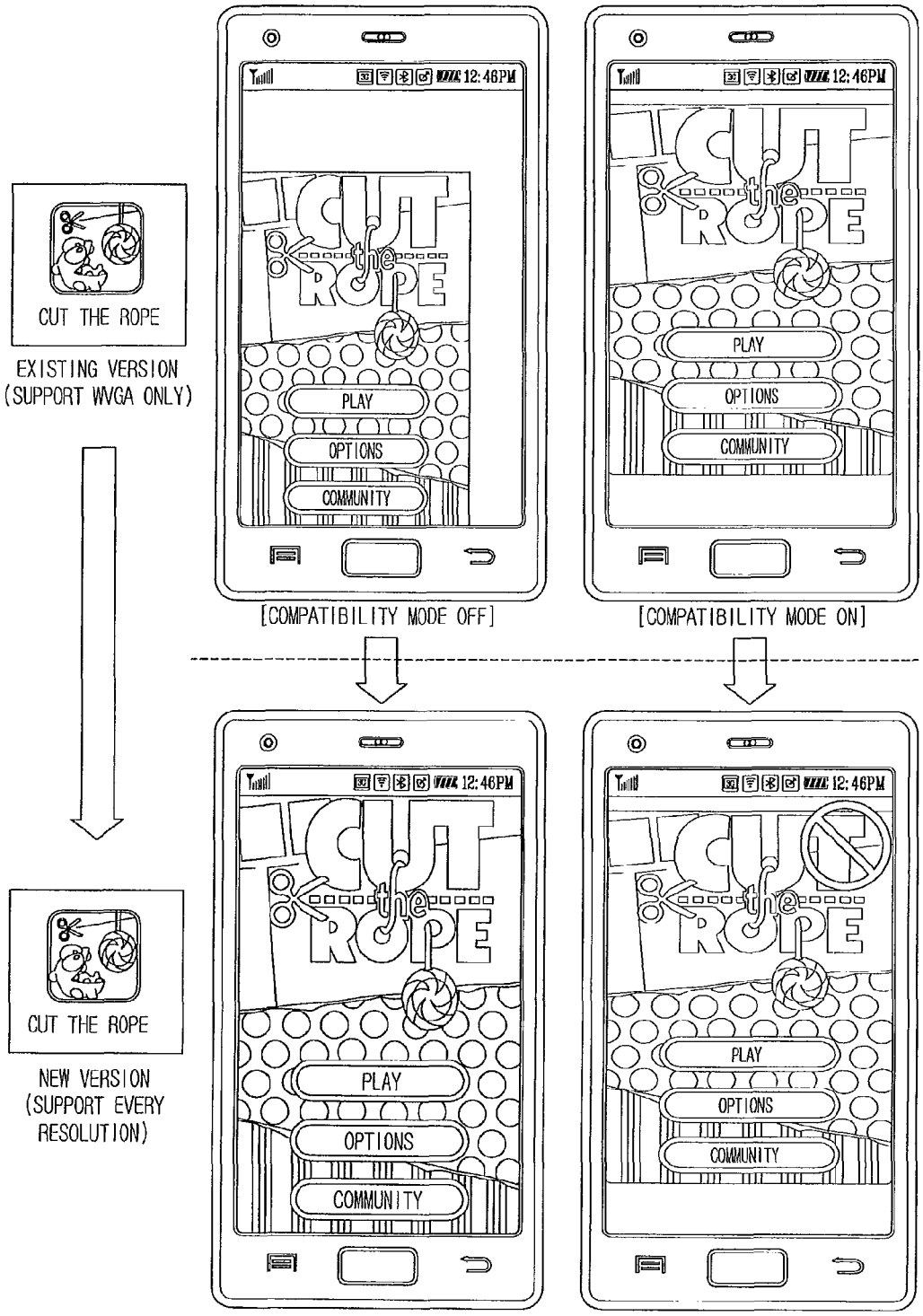
FIG. 12 is a view showing an example of applying a resolution compatibility mode according to an application version.

FIG. 12 shows an example of applying a resolution compatibility mode according to an application version.

As shown in FIG. 12, an existing version of an application which supports only a specific resolution (e.g., WVGA) may be normally displayed to some degree only when the compatibility mode is on. That is, the application may be displayed so enough for the user to view it without inconvenience although not using an entire LCD screen.

However, recently released applications are upgraded to support various resolutions, so they may be normally displayed even without setting the resolution compatibility mod e. Hence, when the compatibility mod e is applied to a new version of application whose resolution has been upgraded, a displayed state on a screen may rather get worse than the mode not applied. In this case, the user may rather suffer from releasing the resolution compatibility mode.

Figure 13:
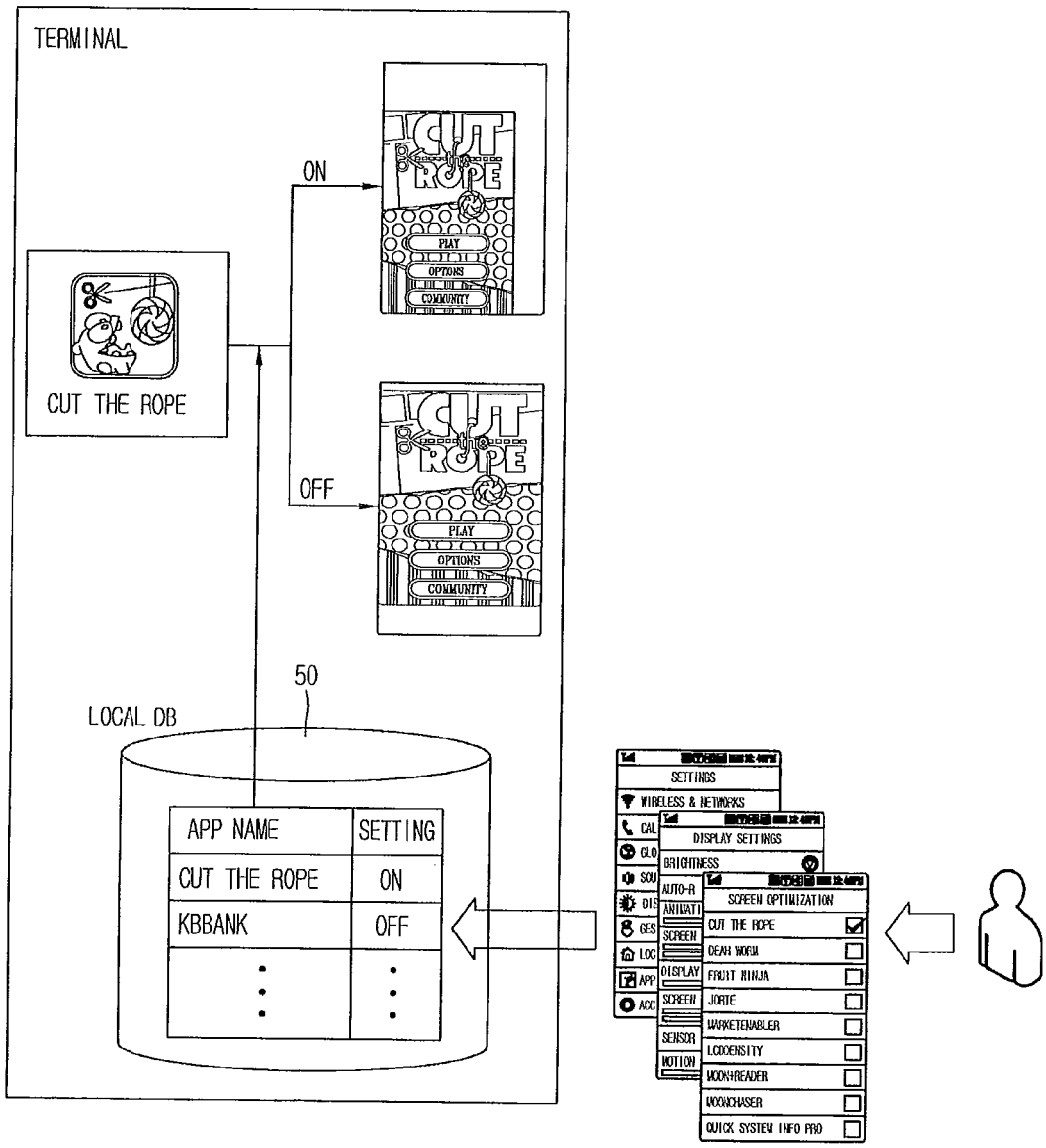
FIG. 13 is a view showing overall operations of adjusting resolution of an application according to a resolution compatibility mode set by a user.

FIG. 13 shows overall operations of adjusting resolution of an application according to a resolution compatibility mode set by a user.

As aforementioned, a user sets a resolution compatibility mode with respect to desired applications through menu setting, and the set information may be stored in the local DB 50. Accordingly, the controller 180 may display each of applications downloaded from an Android market by adjusting their resolutions according to a mode set state (On or Off) stored in the local DB 50.

Figure 14:
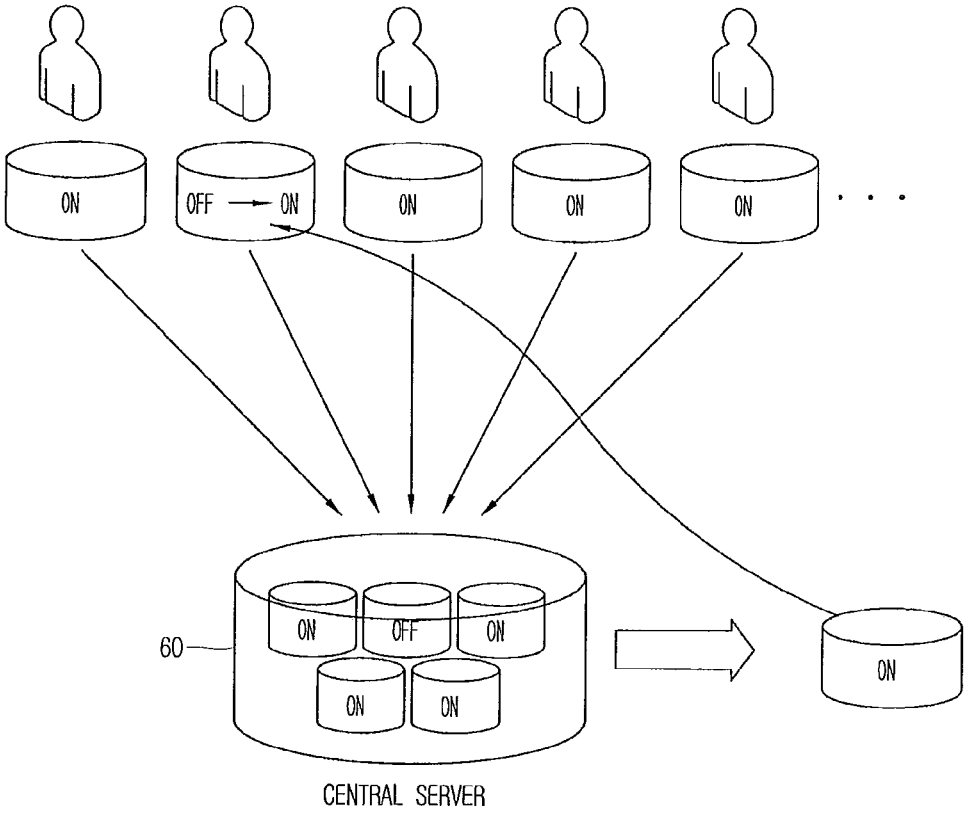
FIG. 14 is a conceptual view of setting a resolution compatibility mode in accordance with an exemplary embodiment.

FIG. 14 is a conceptual view of setting a resolution compatibility mode according to an exemplary embodiment.

In general, when an application with a specific resolution, downloaded from a market, is executed, a set state of the resolution compatibility mode may depend on users. For example, some users may set the resolution compatibility mode with respect to the corresponding application to "On" and other users may set it to "Off".

Therefore, the preset disclosure may be configured such that a central server 60 collects and analyzes the set state of the resolution compatibility mode by each of many users, obtains an optimal set value of the resolution compatibility mode from the analysis result, advises the obtained optimal set value to each user, and provides a guide value to the users to conveniently set the resolution compatibility mode.

The central server 60 may obtain the optimal set value of the resolution compatibility mode, overall taking the following various factors into account.

set a value set by a plurality of users as an optimal set value
set an optimal set value according to an application version
set an optimal set value according to a user-based weight
set an optimal set value by applying a weight according to a time point that the user sets a value A method using a value set by a plurality of users is a method for setting a value ("On" or "Off") (state) of the resolution compatibility mode, which is set by the most users with respect to the same application, as an optimal set value. For example, a set state of the resolution compatibility mode is collected from 100 mobile terminals for analysis. When the resolution compatibility mode is set to "On" state in 90 of the 100 mobile terminals according to the analysis, the central server 60 sets the optimal set value for the resolution compatibility mode to "On", storing the set value in a DB (not shown).

According to a method of setting an optimal set value according to an application version, a version of an application is checked based on a name of the application, and the optimal set value is set to "On" if the version is a previous version whereas being set to "Off" if it is the latest version.

In addition, a method for setting an optimal set value according to a user-based weight, is to set the optimal set value by giving a weight to a value set by a credible user (e.g., manufacturer, power user, etc.) to. This method may be employed for the method using the value set by the plurality of users.

As a method for giving a different weight according to a time of setting the resolution compatibility mode, a weight is given more to the latest set value. This method may also be employed for the method using the value set by the plurality of users.

By employing those methods, the central server 60 may set the optimal set value of the resolution compatibility mode with respect to each application, storing it in a DB (not shown).

When a user downloads an application from a market and stores it in a logical DB 50 of the user's terminal, the resolution compatibility mode of the corresponding application is in a state set to "Optimal". The term "Optimal" indicates that the optimal set value received from the central server 60 will be used as a set value with respect to the resolution compatibility mode.

Therefore, when a specific application (e.g., Cut the Rope) is downloaded and stored in the local DB 50, the controller 180 of the user terminal may request the optimal set value for the corresponding application from the central server 60, and store the requested value in the local DB 50. Here, the request and response for the optimal set value between the controller 180 and the central server 60 may be performed as background.

Figure 15:
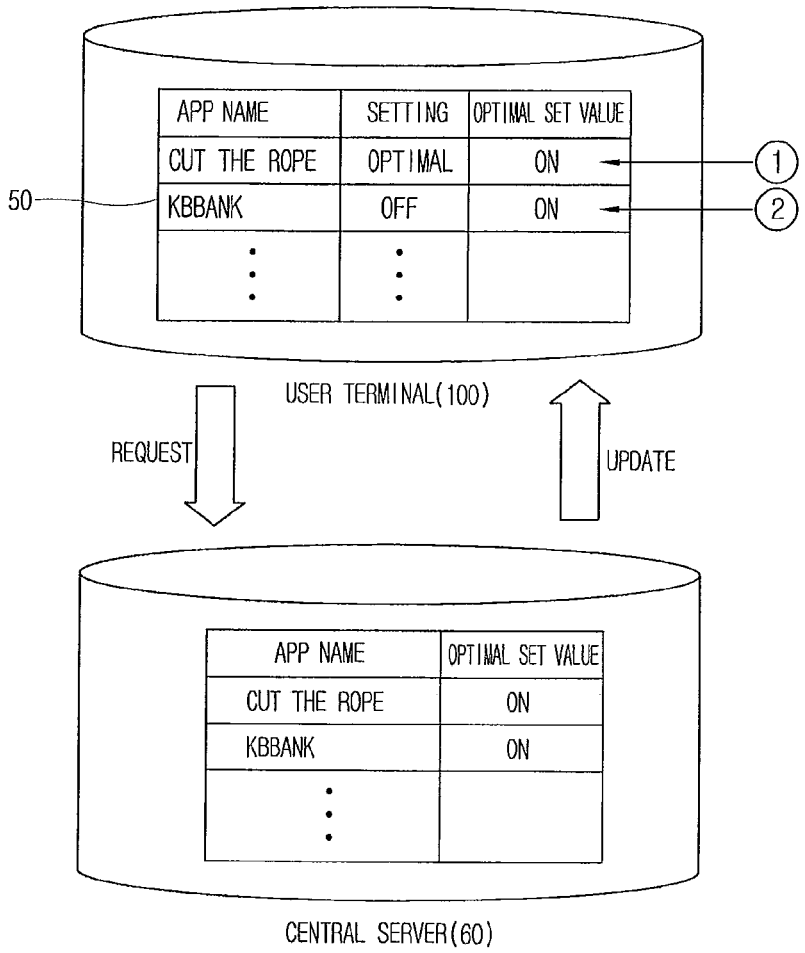
FIG. 15 is a view showing an example of transferring an optimal set value of a resolution compatibility mode between a user terminal and a central server.

FIG. 15 shows an example of transferring an optimal set value for a resolution compatibility mode between a user terminal and a central server.

As shown in FIG. 15, once a new application is installed, a resolution compatibility mode for the corresponding application may be set to three states of On, Off and Optimal. That is, when the new application is installed, the resolution compatibility mode is basically in a state set to "Optimal" as indicated with a reference numeral 1̂. Hence, the controller 180 may work the resolution compatibility mode in the "On" state based on the optimal set value received from the central server 60.

However, when the user explicitly sets the resolution compatibility mode to "On" or "Off" as indicated with a reference numeral 2̂, "Optimal" is released. Therefore, the controller 180 may work the resolution compatibility mode in the "Off" state according to a user-set value with ignoring the optimal set value.

In the meantime, the central server 60 stores optimal set values for a lot of applications, but a user terminal merely needs a set value for an application actually installed therein.

Accordingly, the controller 180 of the user terminal may request for updating of optimal set values by transmitting an update list to the central server 60, and in turn, the central server 60 may transfer only optimal set values for the requested applications based on the updated list to each user terminal. Hence, the controller 180 may receive the optimal set value from the central server 60 upon initial installation of the application or periodically, and update the optimal set value stored in the local DB 50. Here, the controller 180 may display a specific message for a user to determine whether or not to update the optimal set value.

This mechanism of advising (recommending) the optimal set value may be applicable even to general set values without a limit to "resolution compatibility mode".

As one example, the central server may collect information related to a mobile terminal, for example, an idle screen or ringtone usage pattern from each of plural users to manage popular idle screens or ringtones as data, thereby recommending them to a user in response to a request of the controller 180 when the user initially purchases a terminal. Here, the controller 180 may request for user approval by outputting a message for checking whether or not to install the corresponding popular idle screen or ringtone.

Figure 16:
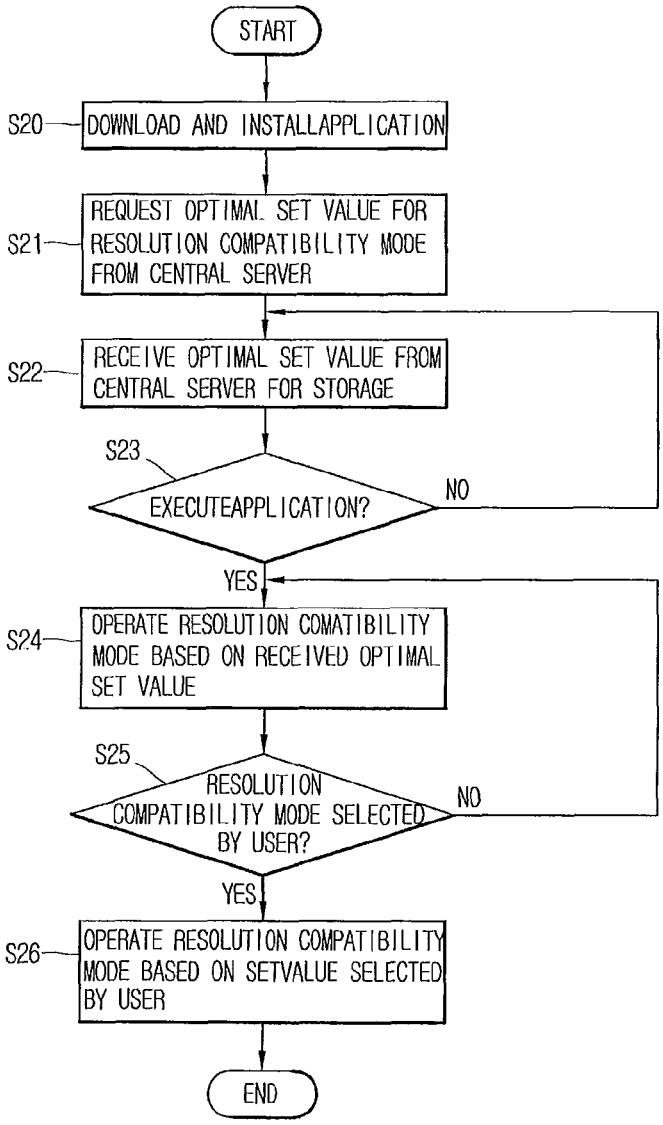
FIG. 16 is a flowchart showing a resolution compatibility method in accordance with a second exemplary embodiment of the present disclosure.

FIG. 16 is a flowchart showing a resolution compatibility method in accordance with a second exemplary embodiment.

As shown in FIG. 16, a user may download a desired application from a market (e.g., market application) for installation (S20). Since a resolution compatibility mode for the downloaded application is in a state set to "Optimal", the controller 180 may request an optimal set value for the resolution compatibility mode from the central server 60 (S21). Then, the controller 180 may receive the optimal set value from the central server 60 and store the received optimal set value in a local server 50 of the memory 160 (S22). The request and reception of the optimal set value may be executed as a background.

Accordingly, when the market application is executed, the controller 180 may execute the resolution compatibility mode based on the stored optimal set value, displaying the market application on the display unit 151 (S23, S24).

Under this state, when the user sets the resolution compatibility mode through menu setting (S25), then the controller 180 may change "Optimal" into a value (On or Off) set by the user, working the resolution compatibility mode based on the set value selected by the user other than the optimal set value (S26).

Also, the controller 180 may periodically provide a list of set values stored in the local DB 50 to the central server 60, updating the set values.

As described above, according to an LCD resolution compatibility method of the present disclosure, when resolution of a market application is different from LCD resolution, the application image may be displayed on a window based on WVGA resolution and then enlarged and displayed based on an actual LCD resolution. This may provide an effect of displaying the application image with the same figure as displayed on the WVGA LCD and text and lines more clearly irrespective of an actual LCD size.

In addition, the present disclosure may provide a user with a set value for a resolution compatibility mode of a market application or a set value required to operate a mobile terminal at a specific time point (upon downloading or purchasing), based on usage patterns of a plurality of users and versions of applications. This may allow the user to conveniently execute resolution matching or set a desired function (e.g., popular idle screen or ringtone).

Further, in accordance with one embodiment of the present disclosure, the method can be implemented as computer-readable codes in a program-recorded medium. The computer-readable medium may include all types of recording devices each storing data readable by a computer system. Examples of such computer-readable media may include ROM, RAM, CD-ROM, magnetic tape, floppy disk, optical data storage element and the like. Also, the computer-readable medium may also be implemented as a format of carrier wave (e.g., transmission via an Internet). The computer may include the controller 180 of the mobile terminal.

The configurations and methods of the mobile terminal in the aforesaid embodiments may not be limitedly applied, but such embodiments may be configured by a selective combination of all or part of the embodiments so as to implement many variations.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A resolution compatibility method for a mobile terminal, the method comprising:

setting a plurality of compatibility modes in a display menu, each compatibility mode including at least one application selected by a user;

confirming a compatibility mode set for an application if the application is executed in a resolution compatibility mode;

drawing an image of the application at a virtual standard resolution of the confirmed compatibility mode;

selectively enlarging or reducing the drawn virtual image of the application to fit an actual LCD size, the virtual standard resolution being different from the resolution of the LCD; and displaying the enlarged or reduced application image on a display unit, wherein the selectively enlarging or reducing the drawn virtual image comprises:

enlarging the virtual drawn image of the application if the virtual standard resolution is lower than the resolution of the LCD; and reducing the virtual drawn image of the application if the virtual standard resolution is higher than the resolution of the LCD, wherein the plurality of compatibility modes have different virtual standard resolution, wherein the virtual standard resolution is not stored in a memory, wherein the virtual standard resolution is determined only based on a resolution of the application when the application is executed, and wherein the determined virtual standard resolution is equivalent to the resolution of the application.

2. The method of claim 1, wherein the resolution of the application is different from the actual LCD resolution.

3. The method of claim 1, wherein the virtual standard resolution is one of Half VGA (HVGA), High Definition (HD) and eXtended Graphics Array (XGA), and the actual LCD resolution comprises HVGA resolution, HD resolution and XGA resolution.

4. The method of claim 1, wherein the virtual application image is drawn on a window and then enlarged or reduced on a canvas.

5. The method of claim 1, further comprising:

receiving an optimal set value of a resolution compatibility mode with respect to the application; and providing the received optimal set value as a guide value for setting the resolution compatibility mode.

6. The method of claim 5, wherein the resolution compatibility mode of the application is in a state set to "optimal" upon downloading the application.

7. The method of claim 5, wherein the optimal set value is requested as a background for reception.

8. The method of claim 5, wherein the optimal set value is a set value with respect to the resolution compatibility mode that users have the most frequently set for the corresponding application, or a set value decided based on an application version.

9. The method of claim 8, wherein the optimal set value is decided by giving a different weight for each user or according to a time point that the user sets the value.

10. The method of claim 5, further comprising:

executing the resolution compatibility mode based on a user-set value with ignoring the optimal set value when the user separately sets the value for the resolution compatibility mode with respect to the application.

11. A mobile terminal comprising:

a memory configured to store at least one application;

a display unit configured to display the application; and a controller configured to:

set a plurality of compatibility modes in a display menu, each compatibility mode including at least one application selected by a user;

confirm a compatibility mode set for an application if the application is executed in a resolution compatibility mode;

draw an image of the application at a virtual standard resolution of the confirmed compatibility mode;

selectively enlarge or reduce the drawn virtual image of the application to fit an actual LCD size, the virtual standard resolution being different from the resolution of the LCD; and display the enlarged or reduced application image on a display unit, wherein the controller is further configured to:

enlarge the drawn virtual image of the application if the virtual standard resolution is lower than the resolution of the LCD; and reduce the drawn virtual image of the application if the virtual standard resolution is higher than the resolution of the LCD, wherein the plurality of one compatibility modes have different virtual standard resolutions, wherein the virtual standard resolution is not stored in a memory, wherein the virtual standard resolution is determined only based on a resolution of the application when the application is executed, and wherein the determined virtual standard resolution is equivalent to the resolution of the application.

12. The terminal of claim 11, wherein the resolution of the application is different from the actual LCD resolution.

13. The terminal of claim 11, wherein the virtual standard resolution is one of Half VGA (HVGA), High Definition (HD) and eXtended Graphics Array (XGA), and the actual LCD resolution comprises HVGA resolution, HD resolution and XGA resolution.

14. The terminal of claim 11, wherein the virtual application image is drawn on a window and then enlarged or reduced on a canvas.

15. The terminal of claim 11, wherein the controller comprises:

a surface flinger configured to request a resolution of an LCD from an Android framework when the application is executed, so as to draw an image of the application based on a virtual standard resolution provided from the Android framework; and an Android framework configured to provide the virtual standard resolution to the surface flinger, when the resolution compatibility mode has been set, in response to the request for the resolution of the LCD from the surface flinger, wherein the virtual standard resolution is set as the resolution of the application.

16. The terminal of claim 11, wherein the controller is further configured to receive an optimal set value of a resolution compatibility mode from a server upon downloading an application from a market, and provide the received optimal set value as a guide value for setting the resolution compatibility mode.

17. The terminal of claim 16, wherein the resolution compatibility mode of the application is in a state set to "optimal" upon downloading the application.

18. The terminal of claim 16, wherein the controller requests for the optimal set value as a background for reception.

19. The terminal of claim 16, wherein the server decides and manages the optimal set value based on a set value of the resolution compatibility mode that users have the most frequently set for the application, or an application version.

20. The terminal of claim 19, wherein the server gives a different weight for each user or according to a time point that the user sets the value upon deciding the optimal set value.

21. The terminal of claim 16, wherein the controller executes the application based on a user-set resolution compatibility mode, with ignoring the optimal set value, when a user sets the resolution compatibility mode with respect to the application.

22. The method of claim 1, wherein drawing the image of the application at the virtual standard resolution comprises:

requesting, from a surface flinger to an Android framework, a resolution of an LCD of the mobile terminal;

checking, in the Android framework, whether the resolution compatibility mode has been set if the application is executed;

providing, from the Android framework to the surface flinger, the resolution of the application instead of the resolution of the LCD as the virtual standard resolution; and drawing, in the surface flinger, an image of the application at the resolution of the application that is same with the virtual standard resolution.

* * * * *